US008430078B2

(12) United States Patent
Heyse et al.

(10) Patent No.: US 8,430,078 B2
(45) Date of Patent: Apr. 30, 2013

(54) FUEL INJECTION VALVE

(75) Inventors: Joerg Heyse, Besigheim (DE); Wilhelm Hopf, Sachsenheim (DE); Juergen Lander, Stuttgart (DE); Dieter Holz, Affalterbach (DE)

(73) Assignee: Robert Bosch GmbH, Stuttgart (DE)

( * ) Notice: Subject to any disclaimer, the term of this patent is extended or adjusted under 35 U.S.C. 154(b) by 289 days.

(21) Appl. No.: 12/809,689

(22) PCT Filed: Dec. 17, 2008

(86) PCT No.: PCT/EP2008/067792

§ 371 (c)(1),
(2), (4) Date: Jun. 21, 2010

(87) PCT Pub. No.: WO2009/080671

PCT Pub. Date: Jul. 2, 2009

(65) Prior Publication Data

US 2010/0269788 A1 Oct. 28, 2010

(30) Foreign Application Priority Data

Dec. 21, 2007 (DE) ..... 10 2007 062 188
Dec. 17, 2008 (DE) ..... 10 2008 054 840

(51) Int. Cl.
*F02B 5/00* (2006.01)
*F02B 17/00* (2006.01)

(52) U.S. Cl.
USPC ..... 123/305; 123/295

(58) Field of Classification Search ..... 123/295, 123/298, 305, 306, 490, 498, 499; 239/533.12, 239/533.14, 533.3, 900, 585.1; 251/129.15, 251/129.21

See application file for complete search history.

(56) References Cited

U.S. PATENT DOCUMENTS 5,996,227 A * 12/1999 Reiter et al. ..... 29/888.45
6,019,296 A 2/2000 Yamamoto et al.
6,039,271 A 3/2000 Reiter
6,105,883 A 8/2000 Takeda et al.

(Continued)

FOREIGN PATENT DOCUMENTS

DE 19546428 6/1997
DE 19631066 2/1998

(Continued)

OTHER PUBLICATIONS

International Search Report, PCT International Patent Application No. PCT/EP2008/067792, dated Apr. 6, 2009.

*Primary Examiner* — Mahmoud Gimie
(74) *Attorney, Agent, or Firm* — Kenyon & Kenyon LLP

(57) ABSTRACT

A fuel injection valve is characterized in that a multi-fan stream nozzle is shaped, downstream from a fixed valve seat that is provided on the inner wall of a valve sleeve, directly into the valve sleeve itself. The multi-fan stream nozzle is integrated directly in the region of a bulge formed at the downstream end of the valve sleeve. The multi-fan stream nozzle, serving as an atomization device, possesses a plurality of slit-shaped spray openings, so that from the sheets of liquid emerging from the spray openings, sheet packets are formed in which individual sheets of liquid extend divergently from one another. Introduction of the spray openings into the deep-drawn valve sleeve is effected using ultrashort-pulse laser technology. The fuel injection valve is suitable in particular for use in fuel injection systems of mixture-compressing spark-ignited internal combustion engines.

14 Claims, 5 Drawing Sheets

U.S. PATENT DOCUMENTS

| | | | | |
|---|---|---|---|---|
| 6,131,826 | A | 10/2000 | Teiwes | |
| 6,173,914 | B1 | 1/2001 | Hopf et al. | |
| 2002/0000483 | A1* | 1/2002 | Shoji et al. | 239/533.2 |
| 2003/0052203 | A1 | 3/2003 | Arndt et al. | |
| 2005/0194470 | A1* | 9/2005 | Vich | 239/585.1 |
| 2006/0231065 | A1* | 10/2006 | Pontoppidan | 123/305 |
| 2009/0301442 | A1 | 12/2009 | Reiter | |
| 2009/0321541 | A1 | 12/2009 | Holzgrefe et al. | |

FOREIGN PATENT DOCUMENTS

| | | |
|---|---|---|
| DE | 19636396 | 3/1998 |
| DE | 19653832 | 6/1998 |
| DE | 19726991 | 1/1999 |
| DE | 19847625 | 4/1999 |
| DE | 102005000620 | 7/2006 |
| DE | 102005052252 | 5/2007 |
| GB | 669110 | 3/1952 |
| JP | 3-133588 | 6/1991 |
| JP | 5-157023 | 6/1993 |
| JP | 9-66381 | 3/1997 |
| JP | 10-274129 | 10/1998 |
| JP | 11-82244 | 3/1999 |
| JP | 2001-65431 | 3/2001 |
| JP | 2002-130080 | 5/2002 |
| JP | 2003-502576 | 1/2003 |
| JP | 2004-28078 | 1/2004 |
| JP | 2004-518858 | 6/2004 |
| JP | 2004-225626 | 8/2004 |
| JP | 2006-258035 | 9/2006 |
| JP | 2007-120471 | 5/2007 |
| JP | 2007-292035 | 11/2007 |
| JP | 2007-313525 | 12/2007 |
| WO | WO 02/06665 | 1/2002 |
| WO | WO 2007/073975 | 7/2007 |

* cited by examiner

FUEL INJECTION VALVE

FIELD OF THE INVENTION

The present invention relates to a fuel injection valve.

BACKGROUND INFORMATION

German Patent Application No. DE 196 36 396 A1 describes a fuel injection valve in which an orifice disk that has a plurality of spray openings is provided downstream from the valve seating surface. The spray openings, e.g., ten to twenty, are located in a plane of the orifice disk that extends perpendicular to the longitudinal valve axis. The majority of the spray openings are introduced into the orifice disk in oblique or inclined fashion, so that the opening axes possess no parallelism with respect to the longitudinal valve axis. Because the inclinations of the spray openings can be selected to be different, a divergence of the individual streams that are to be sprayed out is easily achievable. The spray openings are introduced into the orifice disk at a largely uniform size, for example by laser-beam drilling. The fuel injection valve is suitable in particular for fuel injection systems of mixture-compressing spark-ignited internal combustion engines.

German Patent Application No. DE 198 47 625 A1 describes a fuel injection valve in which a slit-shaped outlet opening is provided at the downstream end. The outlet opening is embodied either in an orifice disk or directly in the nozzle body. The slit-shaped outlet openings are always introduced centrally on the longitudinal valve axis, so that the fuel is sprayed out from the fuel injection valve in axially parallel fashion.

Provided upstream from the valve seat is a swirl groove that imparts a circular rotary motion to the fuel flowing to the valve seat. The flat outlet opening ensures that the fuel is sprayed out in fan fashion.

U.S. Pat. No. 6,019,296 A describes a further fuel injection valve for direct injection of fuel into a combustion chamber of an internal combustion engine, in which a slit-shaped outlet opening, from which fuel can emerge at an angle to the longitudinal valve axis, is provided at the downstream end.

German Patent Application No. DE 10 2005 000 620 A1 describes a multiple fan-stream nozzle for a fuel injection valve, which nozzle possesses, in a central region, a dome-shaped outward bulge into which are introduced, for example, a plurality of directionally parallel slit-shaped spray openings. This fan-stream nozzle is explained below with reference to FIGS. 1 and 2.

SUMMARY

An example fuel injection valve according to the present invention may have the advantage that a very high level of functional integration is achieved in an ultra-high precision valve sleeve according to the present invention. The valve sleeve is embodied as a multifunction sleeve, since it both carries the valve seat and guides the valve needle during its axial movement on the inner wall. In addition to the functions of needle guidance, fuel conveyance, and sealing, the mixture preparation function is also integrated into the multifunction sleeve. Spray openings are introduced directly in a rounded base region at the downstream end of the precision-deep-drawn valve sleeve. With a large number of spray openings, in particular directionally parallel spray slits, the risk of cracking of the webs of material between two adjacent spray openings is greatly reduced. According to an example embodiment of the present invention, a thin orifice disk, and the reshaping of such an orifice disk after introduction of the spray openings, are entirely dispensed with. Instead, the fuel injection valve possesses the spray openings directly in the valve sleeve itself. Introduction of the spray openings occurs, in principle, only after reshaping of the valve sleeve. The risk of cracking of the webs between the spray openings is thereby greatly reduced.

Introduction of the spray openings in this fashion results, in simple fashion, in homogeneous ultrafine atomization of the fuel; a particularly high preparation quality and atomization effectiveness are attained with very small fluid droplets. Ideally, the valve sleeve possesses so many spray openings that it can act as a multiple fan-stream nozzle at the downstream end of the fuel injection valve, so that a plurality of spatially offset fan streams emerge from the valve sleeve and form laminar packets, such that the individual sheets of liquid move divergently with respect to one another and allow air aspiration between the fan streams. Fuel sprays having extremely small fuel droplets, with a Sauter mean diameter (SMD) of approximately 20 μm, can be sprayed out in this fashion. The hydrocarbon emissions of the internal combustion engine can thus be greatly reduced in very effective fashion.

The example design of a valve sleeve according to the present invention offers the requisite geometrical degrees of freedom for variant-dependent directional and fanning control of the individual fan streams. Stream control can be managed very effectively with the available geometrical parameters.

In order to help ensure high precision in the deep-drawn parts, the deep drawing process is adapted in such a way that free-form surfaces that serve as a material overflow are provided in regions adjacent to regions having a high precision requirement, so that process fluctuations can be compensated for. A further possibility for improved precision is local heating (laser, induction, resistance heating, friction, chemical reaction) of the valve sleeve during the deep drawing process. Local improvements in properties with regard to hardness, strength, hardenability, wear, elasticity, etc. can be achieved by plating a higher-grade material onto the material of the valve sleeve.

Specifically adapted post-processing methods can be utilized for maximum sealing capability and particular strength requirements, or for wear-related reasons. The valve seating surface, for example, is brought to the desired surface quality in a finishing operation using annular hones with embedded grit, and laser-hardened. Because the valve seating surface projects inward peripherally as a ridge, only the ridge tip that serves for valve seating has to be precisely machined.

Using appropriate impressing processes in a suitable drawing step, it is possible to achieve a local adaptation of the wall thickness that enables cost-effective production of the spray openings for optimized mixture preparation.

The spray openings are introduced after the valve sleeve deep drawing process, in particular using ultrashort-pulse laser technology. This laser technology enables laser-based production of spray openings with a sufficiently accurate cross-sectional precision that is necessary, for example, for spraying out sheets of liquid in the form of multiple fan streams.

BRIEF DESCRIPTION OF THE DRAWINGS

Example embodiments of the present invention are depicted in simplified fashion in the figures, and explained further below.

DETAILED DESCRIPTION OF EXAMPLE EMBODIMENTS

Figure 1:
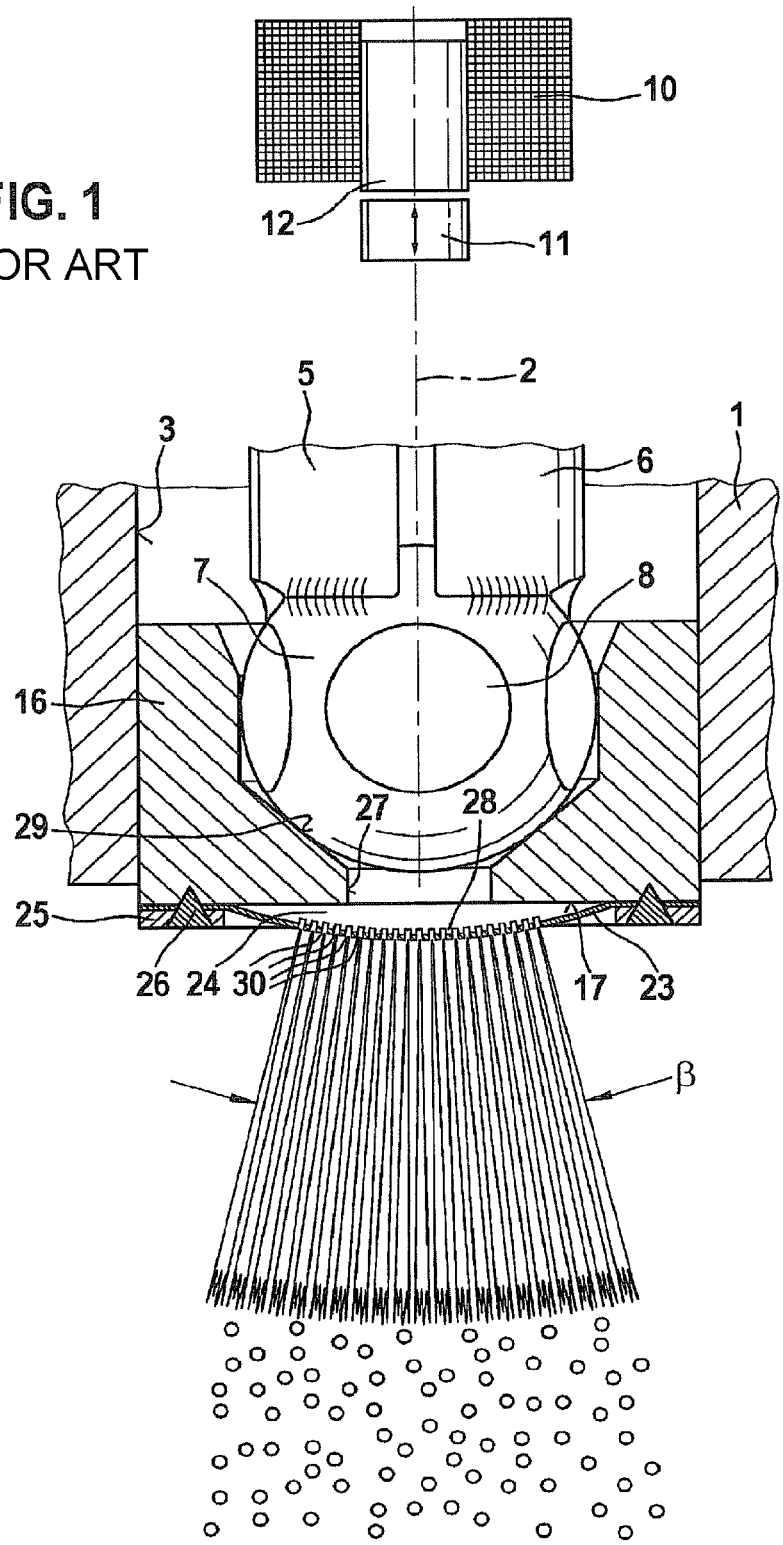
FIG. 1 PRIOR ART
FIG. 1 is a side view partially depicting a valve in the form of a fuel injection valve, having an exemplifying embodiment of a conventional multiple fan-stream nozzle.

FIG. 1 partly depicts, as an example embodiment, a valve in the form of an injection valve for fuel injection systems of mixture-compressing spark-ignited internal combustion engines. The fuel injection valve has a tubular valve seat carrier 1 (only schematically indicated) forming part of a valve housing, in which carrier a longitudinal opening 3 is embodied concentrically with a longitudinal valve axis 2. Arranged in longitudinal opening 3 is a, for example, tubular valve needle 5 that is fixedly connected at its downstream end 6 to a, for example, spherical valve closure element 7 on whose periphery are provided, for example, five flattened areas 8 past which fuel flows.

Actuation of the fuel injection valve is accomplished in conventional fashion, for example electromagnetically. Actuation of the fuel injection valve with a piezoelectric or magnetostrictive actuator is, however, also possible. A schematically indicated electromagnetic circuit having a solenoid 10, an armature 11, and a core 12 serves to move valve needle 5 axially and thus to open the fuel injection valve against the spring force of a return spring (not depicted), and to close it. Armature 11 is joined to the end of valve needle 5 facing away from valve closure element 7, for example, by way of a weld seam embodied by means of a laser, and is aligned with core 12.

A valve seating element 16 is installed sealedly, for example by welding, in the end of valve seat carrier 1 located downstream. An orifice disk 23 in the form of a multiple fan-stream nozzle is mounted as an atomizer device on the lower end face 17, facing away from valve closure element 7, of valve seating element 16. Valve seating element 16 and orifice disk 23 are connected, for example, by a peripheral and sealing weld seam 26, embodied using a laser, that is provided e.g. on end face 17 or on the outer periphery of valve seating element 16 and orifice disk 23. For secure mounting of the very thin orifice disk 23 on valve seating element 16, orifice disk 23 is supported from below by a backing washer 25. Backing washer 25 is configured annularly in order to receive, in an inner opening, a central domed or bulged-out cap-like nozzle region 28 of orifice disk 23.

Provided in valve seating element 16, downstream from a valve seating surface 29, is an outlet opening 27 from which the fuel to be sprayed out enters a flow cavity 24 that is formed by the rounded or domed configuration of nozzle region 28 of orifice 23. Orifice disk 23 is at its greatest distance from end face 17, for example, in the region of longitudinal valve axis 2, whereas in the region of weld seam 26, orifice disk 23 rests, as a disk having no bulge, directly against valve seating element 16 and is stabilized by backing washer 25.

A plurality of very small spray openings 30, which are embodied in slit fashion and extend directionally parallel, are provided in orifice disk 23 and in particular in its nozzle region 28. Spray openings 30 each have a slit width of approx. 20 to 50 μm and a slit length of up to 150 μm, so that fuel sprays with very small fuel droplets, having a Sauter mean diameter (SMD) of approx. 20 μm, can be sprayed out. The hydrocarbon emissions of the internal combustion engine can thereby be greatly reduced, in very effective fashion, as compared with known injection assemblages. Between two and sixty spray openings 30 are provided for each orifice disk 23; a quantity from eight to forty spray openings 30 yields optimum atomization results.

Figure 2:
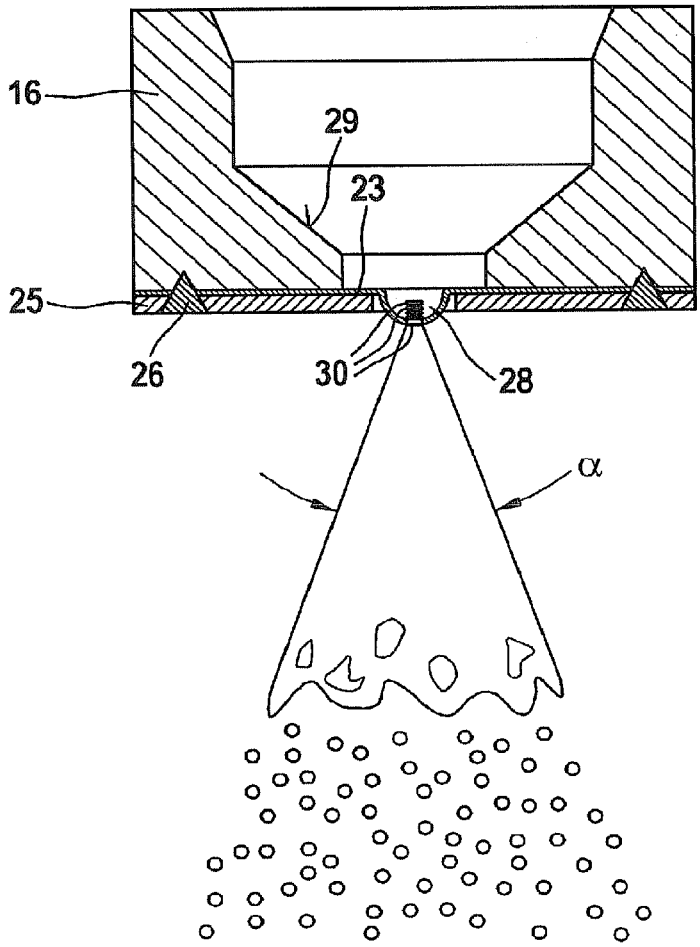
FIG. 2 PRIOR ART
FIG. 2 is a side view, rotated 90°, of the valve end having the multiple fan-stream nozzle according to FIG. 1.

FIG. 2 is a side view, rotated 90°, of the downstream valve end of the fuel injection valve having orifice disk 23 as shown in FIG. 1. It is particularly evident here that central nozzle region 28 has an elongated elliptical shape. Whereas the discharged fuel spray possesses in its longitudinal orientation as shown in FIG. 1, for example, an external angle $\beta$ of approx. 15°, an external angle $\alpha$ of the fuel spray in its transverse orientation as shown in FIG. 2 is equal to approx. 30°.

FIGS. 1 and 2 are from German Patent Application No. DE 10 2005 000 620 A1 and thus show a conventional multiple fan-stream nozzle 23. Central nozzle region 28 having spray openings 30 is shaped by impressing technology after galvanic manufacture of the disk. Impressing tools that are either annular or partly annular, or elliptical or partly elliptical, in configuration can be used to manufacture nozzle region 28 of orifice disk 23 (FIGS. 10 and 11 of DE 10 2005 000 620 A1). The bulge of nozzle region 28 is shaped out to face convexly in the spray direction. With this conventional approach to the elliptically bulged-out nozzle region 28, the disadvantageous problem can occur that the webs of material between each two adjacent slit-shaped spray openings 30 can crack in the context of mechanical reshaping, i.e., as the typically protruding bulge of nozzle region 28 is shaped in. In negative fashion, considerable deviations from the desired spray pattern, and from the fuel quantity intended to be delivered, can thus occur. Dangerously close slit spacings occur especially with designs for orifice disk 23 in which a large flow volume and a large number of spray openings 30 are desired.

Figure 3:
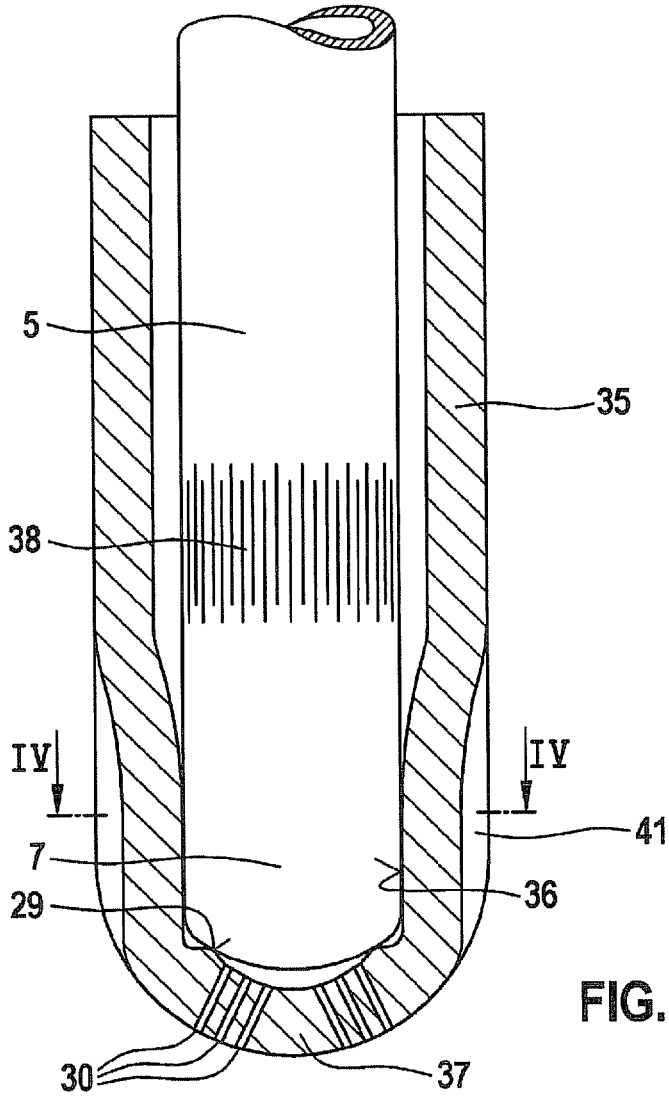
FIG. 3 shows a valve end of a first fuel injection valve according to an example embodiment of the present invention.

FIG. 3 shows a valve end of a fuel injection valve according to the present invention, in which an orifice disk 23 has been entirely dispensed with. The risk of crack formation is greatly reduced with this configuration according to the present invention, since it is only after reshaping of a valve sleeve 35, which is manufactured in particular by deep drawing, that slit-shaped spray openings 30 are introduced thereinto. As compared with the fuel injection valve shown in FIG. 1, the components encompassed by valve sleeve 35 are a valve seat carrier 1 and valve seating element 16, valve seating surface 29 being co-formed directly onto the inner wall of valve sleeve 35. Valve seating surface 29 is brought to the desired surface quality, for example, by annular honing, and is hardened using a laser.

Valve sleeve 35 is embodied as a multifunction sleeve, since it both carries valve seat 29 and guides valve needle 5 during its axial movement on the inner wall. Valve needle 5 is embodied at its downstream end, which functions as valve closure element 7, without the flattened areas 8 (FIG. 1) conventional for the conveyance of fuel, and instead continues to extend in hollow-cylindrical fashion. Valve sleeve 35, on the other hand, possesses over its downstream peripheral region a plurality of land-shaped guide regions 36, which are radially inwardly displaced with respect to the cylindrical profile of valve sleeve 35 and serve to guide valve needle 5.

Figure 4:
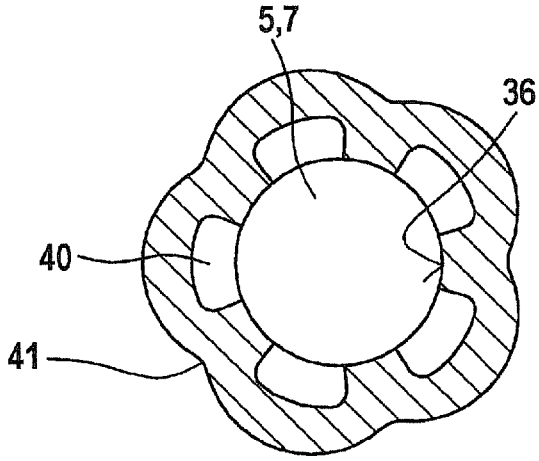
FIG. 4 is a section, along line IV-IV in FIG. 3, through the downstream end of the fuel injection valve.

Ideally, an odd number of, i.e., for example three or five, guide regions 36 are impressed into valve sleeve 35, as is evident from the sectioned depiction through the lower end of valve sleeve 35 in FIG. 4. This results in depressions 41 on the outer periphery of valve sleeve 35 in the regions of the inwardly directed guide regions 36, since the material of valve sleeve 35 is compressed, displaced, impressed, or the like toward the inside. The provision of guide regions 36 distributed over the periphery produces between them a corresponding number of flow channels 40 that serve to convey fuel to valve seating surface 29. Valve needle 5 is, like valve sleeve 35, manufactured, e.g., by deep drawing.

As a particular aspect of the functional integration in valve sleeve 35, the deep-drawn valve sleeve 35 is equipped at the downstream end with a bulge 37 into which the, in particular, slit-shaped spray openings 30 are directly introduced. Bulge 37 of valve sleeve 35 is embodied, in the example embodiment, rotationally symmetrically in dome-shaped fashion; deviating therefrom it can also be, for example, paraboloid and can be elliptical rather than circular in its base outline. Spray openings 30 are introduced, after the deep drawing process, using ultrashort-pulse laser technology. This laser technology enables, for the first time, laser-based manufacture of spray openings 30 with a sufficiently accurate cross-sectional precision that is necessary for spraying out sheets of liquid in the form of multiple fan streams (FIG. 1). The slit-shaped spray openings 30 can be shaped by laser technology perpendicularly or obliquely with respect to the surface normal line of the rounded valve sleeve 35. If both oppositely located longitudinal slit walls are introduced obliquely and directionally parallel to one another, the center axis of the emerging fan stream can be tilted, regardless of the shape of bulge 37, with respect to the surface normal line of bulge 37.

Figure 5:
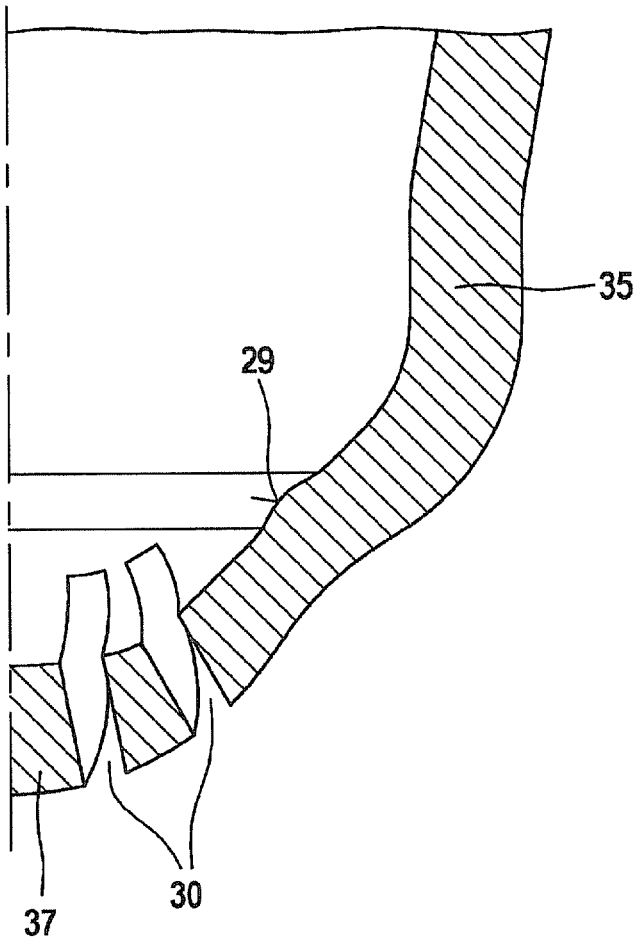
FIG. 5 is an enlarged depiction of slit-like spray openings in a valve sleeve.

FIG. 5 is an enlarged depiction of slit-like spray openings 30 in a valve sleeve 35. Advantageously, the slit walls that extend in the longitudinal slit direction do not delimit spray openings 30 with an orientation that is exactly directionally parallel to one another, but instead diverge from one another in the spraying direction in accordance with a fan-stream fanning angle that is to be established. Instead of the planar walls (as shown) of spray openings 30, they can also be convexly or concavely rounded. The specific orientation of the laser for generating these walls can be achieved by deflecting the laser beam using tiltable mirrors.

Spray openings 30 can have the cross-sectional shape of a rectangle, an ellipse, or a lens, or the like. Two adjacent spray openings 30 have, for example, a spacing of approximately 40 to 60 μm.

In addition to the slit-shaped spray openings 30 of valve sleeve 35, a likewise slit-shaped structure can be provided in the deep-drawn valve needle 5 upstream of valve seat 29, said structure serving as a filter 38 and being manufactured, for example, by way of a laser.

Figure 6:
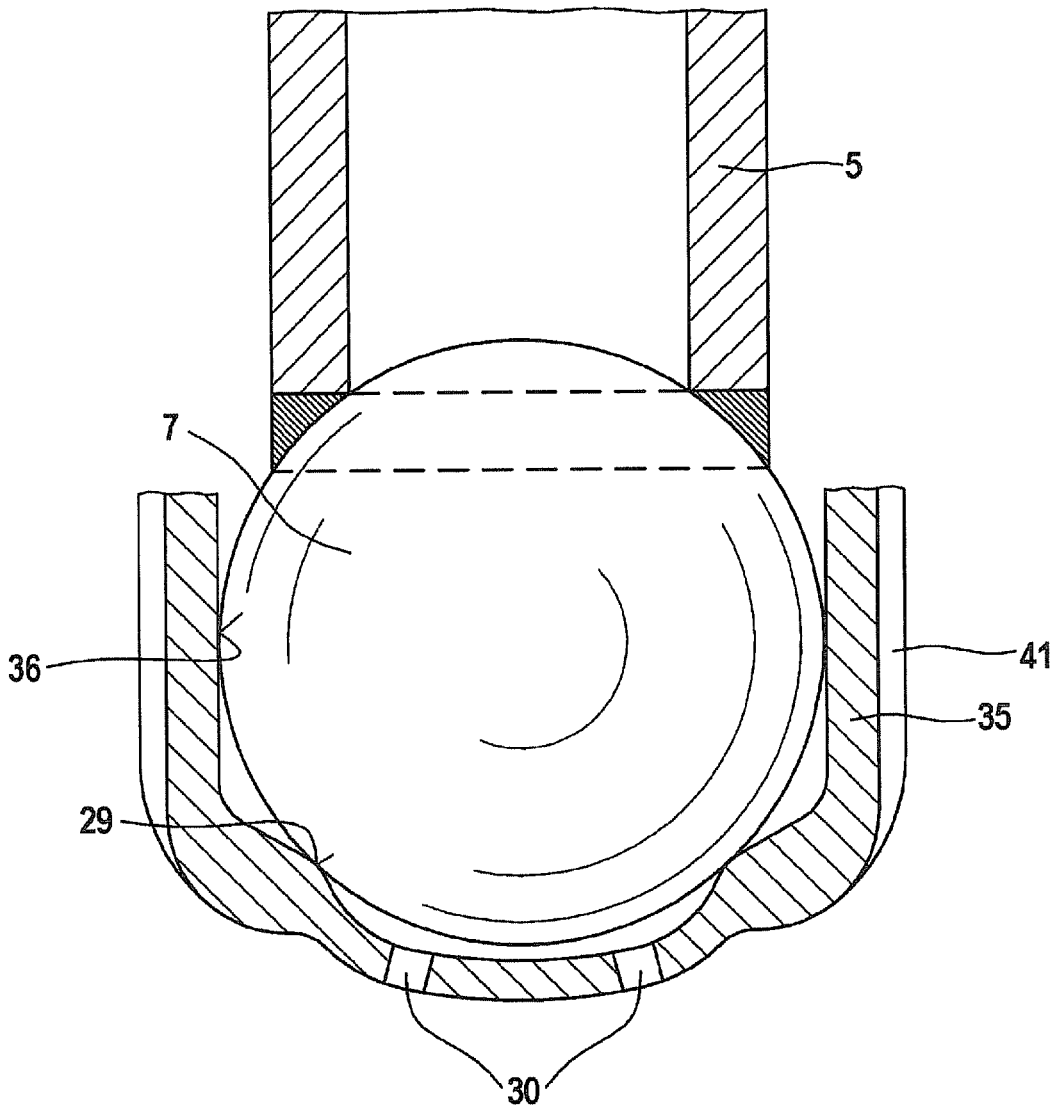
FIG. 6 shows a valve end of a second fuel injection valve according to an example embodiment of the present invention.

FIG. 6 shows a valve end of a second fuel injection valve according to the present invention in which an orifice disk 23 has been entirely dispensed with. As compared with the exemplifying embodiment shown in FIG. 3, this embodiment differs in particular in the configuration of valve needle 5 and of valve closure element 7, and in the embodiments of spray openings 30. The intention of the exemplifying embodiment shown in FIG. 6 is to illustrate that valve sleeve 35, shaped in particular by deep drawing, can also receive a conventional valve needle 5 and having a spherical valve closure element 7. The combination of the high-precision valve sleeve 35, with a soft, highly elastic valve closure element 7 that adapts to the reshaped valve seat 29, results in an improved and economical sealing seat. Valve sleeve 35 once again assumes the function of a valve seat carrier and simultaneously that of the valve seating element, valve seating surface 29 being co-formed directly onto the inner wall of valve sleeve 35.

Valve sleeve 35 is embodied as a multifunction sleeve, since it not only carries valve seat 29 but also guides valve needle 5 during its axial movement on inner wall. In addition to the functions of needle guidance, fuel conveyance, and sealing, the mixture preparation function is also integrated into the multifunction sleeve. Spray openings 30 are introduced directly into a, for example, rounded base region at the downstream end of the precision deep-drawn valve sleeve 35. In addition to the slit-shaped configuration described above, spray openings 30 can also be embodied in circular or polygonal fashion. Spray openings 30 are introduced, after the deep drawing process, using ultrashort-pulse laser technology.

In order to ensure high precision for the deep-drawn parts, the deep drawing process is adapted so that free-form surfaces that serve as a material overflow are provided in regions adjacent to regions having a high precision requirement, with the result that process fluctuations can be compensated for. A further possibility for improved precision is local heating (laser, induction, resistance heating, friction, chemical reaction) of valve sleeve 35 during the deep drawing process. In addition, the influence of internal stresses and texture is largely reduced by appropriate material selection and controlled thermomechanical treatment. This can be accomplished by way of a final annealing with a subsequent calibration step, and/or the use of a texture-free panel or a panel having a rotationally symmetrical texture. Local improvements in properties with regard to hardness, strength, hardenability, wear, elasticity, etc. can be achieved by plating a higher-grade material (applying an additional material) onto the material of valve sleeve 35.

Specifically adapted post-processing methods can be applied for maximum sealing capability and particular strength requirements, or for wear-related reasons. Valve seating surface 29, for example, is brought to the desired surface quality in a finishing operation using annular hones with embedded grit, and laser-hardened. The grinding pencil is designed so that valve seat 29 and the needle guidance region are machined in a single working step, so that very good concentricity is achieved between valve seat 29 and the guide. As a result of the precise pre-machining, economical post-machining is also possible at any time using common precision machining methods (grinding, lapping, impressing, EDM, ECM, laser machining, electron beam machining, etc.). The inner contour of valve sleeve 35, for example, is precisely machined by micro-ECM, by sensing the contour with the electrode in order to perform the ECM process. Because valve seating surface 29 (as shown in FIGS. 3 to 5) projects inward peripherally as a ridge, only the ridge tip that serves for valve seating has to be precisely machined. By flexibly clamping the valve sleeve, it is possible to ensure that the inner contour of valve sleeve 35 aligns itself with the grinding pencil so that positional deviations between the inner and outer contour, caused by deep drawing, are equalized. For production of the press-on diameter, valve sleeve 35 is preferably aligned with the inner contour in order to enable positionally correct installation of valve sleeve 35 on the fuel injection valve.

Using appropriate impressing processes in a suitable drawing step, it is possible to achieve a local adaptation of the wall thickness that enables cost-effective implementation of mixture preparation. Spray openings 30 can be manufactured using all usual methods, for example drilling, punching, laser drilling, EDM, ECM, EDCM, ion beam, electron beam.

What is claimed is:

1. A fuel injection valve for a fuel injection system of an internal combustion engine, the fuel injection valve having a longitudinal valve axis, the fuel injection valve comprising:

a fixed valve seat;

a valve closure element that coacts with the valve seat and is axially movable along the longitudinal valve axis;

spray openings disposed downstream from the valve seat; and a valve sleeve that is equipped at its downstream end with a bulge in which the spray openings are introduced directly;

wherein the valve sleeve is shaped with multiple guide regions, spaced apart over a circumference and directed radially inward, that serve to guide a valve needle.

2. The fuel injection valve as recited in claim 1, wherein the valve seat is co-formed on an inner wall of the valve sleeve.

3. The fuel injection valve as recited in claim 1, wherein the bulge is rotationally symmetrical in one of a dome-shaped fashion or paraboloid-shaped fashion.

4. The fuel injection valve as recited in claim 1, wherein the spray openings are shaped in slit fashion.

5. The fuel injection valve as recited in claim 4, wherein walls of the spray openings which extend in the longitudinal slit direction, diverge from one another in the spraying direction.

6. The fuel injection valve as recited in claim 1, wherein the spray openings are shaped in perpendicularly with respect to a surface normal line of the bulge of the valve sleeve.

7. The fuel injection valve as recited in claim 1, wherein the spray openings are shaped obliquely with respect to a surface normal line of the bulge of the valve sleeve.

8. The fuel injection valve as recited in claim 1, wherein the valve sleeve is reshaped by deep drawing, and introduction of the spray openings is accomplished only after reshaping.

9. The fuel injection valve as recited in claim 1, wherein opening contours of the spray openings are introduced using ultrashort-pulse laser technology.

10. The fuel injection valve as recited in claim 1, wherein the valve closure element is shaped on a deep drawing valve needle.

11. The fuel injection valve as recited in claim 1, wherein an odd number of guide regions are provided.

12. The fuel injection valve as recited in claim 1, wherein depressions are on an outer circumference of the valve sleeve in regions of the inwardly directed guide regions, which depressions thereby define dimensions of flow channels produced on an inner side.

13. The fuel injection valve as recited in claim 10, wherein a slit-shaped structure that serves as a filter is in the valve needle.

14. A fuel injection valve for a fuel injection system of an internal combustion engine, the fuel injection valve having a longitudinal valve axis, the fuel injection valve comprising:

a fixed valve seat;

a valve closure element that coacts with the valve seat and is axially movable along the longitudinal valve axis;

spray openings disposed downstream from the valve seat; and a valve sleeve that is equipped at its downstream end with a bulge in which the spray openings are introduced directly;

wherein the spray openings are formed slit-shaped, and wherein slit walls of the spray openings running in a longitudinal slit direction diverge from one another in a spraying direction corresponding to a fan stream fanning angle to be established.

* * * * *

UNITED STATES PATENT AND TRADEMARK OFFICE

CERTIFICATE OF CORRECTION

PATENT NO. : 8,430,078 B2
APPLICATION NO. : 12/809689
DATED : April 30, 2013
INVENTOR(S) : Heyse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 373 days.

Signed and Sealed this
Eighth Day of September, 2015

Michelle K. Lee

Michelle K. Lee
*Director of the United States Patent and Trademark Office*